US006154232A

United States Patent [19]

Hickman et al.

[11] Patent Number: 6,154,232

[45] Date of Patent: Nov. 28, 2000

[54] DRUM-BASED PRINTERS USING MULTIPLE PENS PER COLOR

[75] Inventors: Mark S Hickman; Steve O Rasmussen; Kenneth R Williams, all of Vancouver, Wash.

[73] Assignee: Hewlett-Packard Company, Palo Alto, Calif.

[21] Appl. No.: 09/233,575

[22] Filed: Jan. 19, 1999

[51] Int. Cl.[7] ..... B41J 2/21; B41J 2/145; B41J 2/15

[52] U.S. Cl. ..... 347/40; 347/43

[58] Field of Search ..... 347/40, 19, 37, 347/43

[56] References Cited

U.S. PATENT DOCUMENTS

| | | | |
|---|---|---|---|
| 4,237,466 | 12/1980 | Scranton | 346/75 |
| 4,538,160 | 8/1985 | Uchiyama | 347/101 |
| 4,940,998 | 7/1990 | Asakawa | 347/37 |
| 5,121,139 | 6/1992 | Burke | 346/138 |
| 5,371,531 | 12/1994 | Rezanka et al. | 347/43 |
| 5,488,397 | 1/1996 | Nguyen et al. | 347/40 |
| 5,517,222 | 5/1996 | Suglyama et al. | 347/35 |
| 5,598,191 | 1/1997 | Kneezel | 347/40 |
| 5,684,518 | 11/1997 | Nobel et al. | 347/50 |
| 5,771,054 | 6/1998 | Dudek et al. | 347/102 |
| 5,871,292 | 2/1999 | Johnson et al. | 400/328 |
| 5,889,534 | 3/1999 | Johnson et al. | 347/19 |

*Primary Examiner*—Thinh Nguyen

[57] ABSTRACT

Inkjet pens are combined in a printer so that the swaths printed by individual pens are combined into a resultant, wide swath that increases printer throughput. The print medium is carried on a drum and advanced through the printer. In a preferred embodiment, sets of two pens, each set having the same color of ink, are carried near the drum with the two pens arranged such that the swath of one pen is adjacent to the swath of the other pen in a direction that is parallel to the drum axis. Also provided is a carriage assembly for carrying the pens in the just mentioned arrangement for combining the swath widths of the individual pens. The components of the carriage assembly are such that two pens of the same color ink are precisely positioned relative to each other, thereby to meet a very close tolerance requirement for arranging two pens of the same color.

16 Claims, 5 Drawing Sheets

DRUM-BASED PRINTERS USING MULTIPLE PENS PER COLOR

TECHNICAL FIELD

This invention relates to inkjet printers, and particularly to a drum-based printer that carries two or more ink pens of the same color.

BACKGROUND AND SUMMARY OF THE INVENTION

An inkjet printer includes one or more ink-filled pens that are mounted to a carriage in the printer body. Normally, the carriage is scanned across the width of the printer as paper or other print media is advanced through the printer. Each ink-filled pen includes a printhead that is driven to expel droplets of ink through an array of nozzles in the printhead toward the paper in the printer. The timing and nominal trajectory of the droplets are controlled to generate the desired text or image output and its associated quality.

These scanning-type printers expel ink while the carriage is reciprocated across the width of the paper. Thus, a swath of ink is printed with each scan and the paper is advanced to a new location between printing swaths. Sometimes, however, the paper is not advanced, or is advanced less than a full print swath, so that another pass may be made by the returning carriage to print over some or all of the last-printed swath. Such multiple passes by scanning-type printers are useful for color printing but can lead to undesirable banding in the output due to changes in the order in which the ink colors reach the paper as a result of the alternating directions of carriage movement.

Throughput, which is normally measured in printed pages per minute, is an important design consideration in connection with printers of all types. The goal is to maximize throughput without deleterious effects on print quality.

One way to increase throughput in inkjet printers is to increase the size of the nozzle array on the printhead of the pen so that the width of the swath of printed ink is correspondingly increased. As printhead swaths increase, however, it becomes increasingly difficult to arrange and move the pens so that the spacing between the paper and nozzle arrays on the printheads remains constant, preferably parallel. This parallelism is important for preventing errors in the placement of ink droplets, especially at the margins of the printheads.

It is also possible to increase printed swath size by making larger monolithic printheads. Increasing printhead sizes beyond certain limits, however, can lead to very poor manufacturing yields. Thus, this approach can lead to more expensive printers than the alternative of combining multiple smaller print swaths together to create a larger, multi-pen print swath.

The width of the printed swath may be increased by mounting two or more of the same color pens in a carriage in a manner such that the swaths of both pens are adjacent to one another to effectively double, triple, etc. the width of the resulting printed swath. This approach, however, in-scanning type printers, increases the complexity of the printer architecture because more components are required for ensuring that the paper is held flat relative to the combined swaths of the pens. Also, it is difficult to efficiently group multiple pens in a scanning type printer without increasing the amount of carriage over-travel or increasing the number of swath-advances required for ensuring that all pens scan the entire width of the paper before the carriage reverses for the next scan. The time required for the over-travel diminishes throughput.

The present invention is directed to a method of combining inkjet pens in a printer so that the swath width is enlarged but while maintaining the printheads and paper parallelism, and without requiring large monolithic printheads having economics that may be relatively poor for a given printed swath width. To this end, the paper is carried on a drum and advanced through the printer. Sets of two pens, each set having the same color of ink, are carried near the drum. The two pens arranged in a carriage such that the swath of one pen is adjacent to the swath of the other pen in a direction that is parallel to the drum axis. As a result, the width of the printed swath for a given color is the sum of the swath widths of the adjacent swaths.

A carriage assembly is provided for carrying the pens in the just mentioned arrangement for combining the swath widths of the individual pens. The components of the carriage assembly are such that two pens of the same color ink are precisely positioned relative to each other, thereby to meet a very close tolerance requirement for arranging pens that print adjacent swaths of the same color.

Multiple sets of relatively small pens are carried near the drum so that a full range of colors can be printed. The present invention ensures that all of the pens' printheads are held sufficiently parallel to the paper to allow excellent print quality. The combination of a drum for advancing the print medium and the arrangement of the pens relative to the drum maintains the desired parallelism while increasing overall swath width for attendant increase in throughput. The drum-based approach also reduces the over-travel problem mentioned above.

Other advantages and features of the present invention will become clear upon study of the following portion of this specification and the drawings.

DETAILED DESCRIPTION OF PREFERRED EMBODIMENTS

Figure 1:
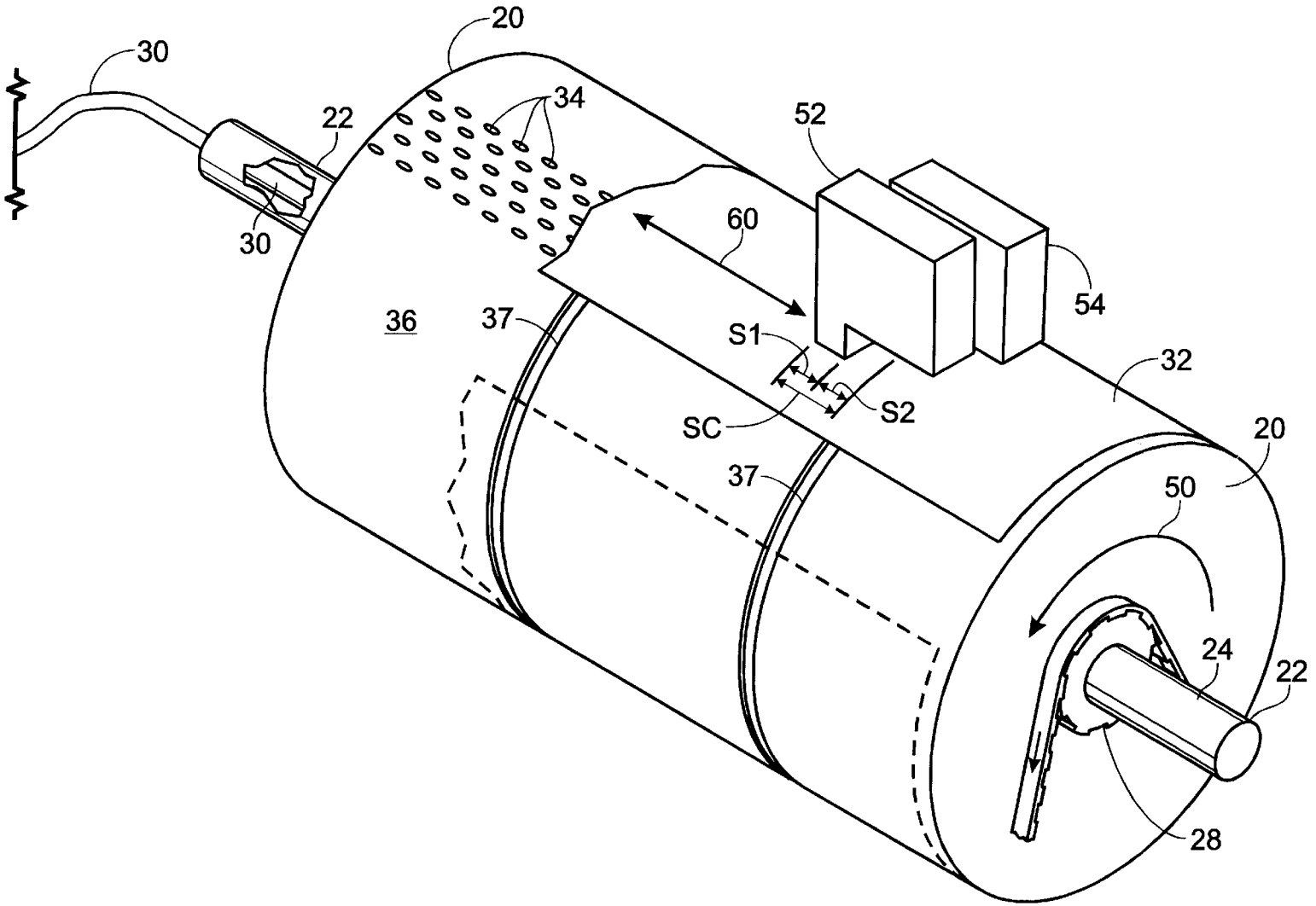
FIG. 1 is a diagram showing in perspective view an arrangement of printer components for implementing the preferred method of carrying inkjet pens in an arrangement that enlarges the overall width of the printed swaths, thereby to increase throughput.
Figure 2:
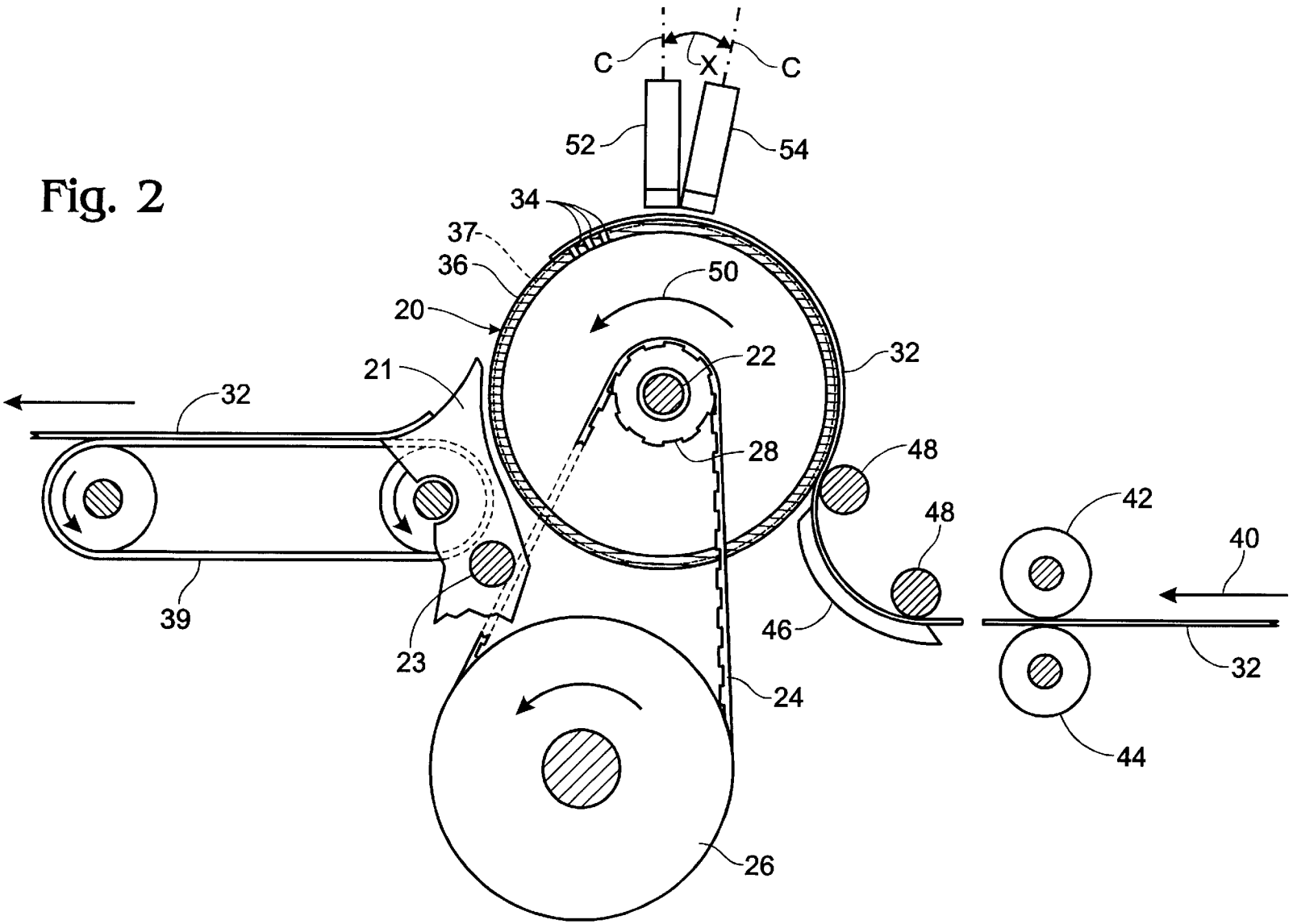
FIG. 2 is a side view of the printer components of FIG. 1.

With reference to FIGS. 1 and 2, a preferred embodiment of the present invention includes a drum 20 that is supported by a shaft 22 within a printer. The drum 20 preferably has a circumference of about 50 cm, although any of a variety of drum sizes will suffice.

An endless drive belt 24 engages a gear 28 that is fixed to one end of the drum 22. That belt also engages a drive pulley 26 (FIG. 2). In a preferred embodiment, a motor (not shown) continuously drives the pulley 26 to rotate the drum whenever a printing operation is carried out.

The other end of the drum shaft 22 is hollow. A vacuum line 30 enters the hollow interior of the drum 20 through the shaft 22. The other end of the vacuum line 30 is connected to a regulated vacuum source. The vacuum is applied to the interior of the drum as a mechanism for securing print medium, such as paper 32, to the drum 20 as the paper is advanced through the printer over the drum. To this end, the drum is perforated with vacuum ports 34 that extend between the interior of the drum and the outer surface 36 of the drum. The suction present in the ports 34 secures to the drum outer surface 36 the paper 32 that is guided into contact with the drum, as is described next. Before proceeding, however, it is noted that the vacuum method of securing paper to drum is only one of a number of suitable approaches. For example, electrostatic attraction, clamping mechanisms, temporary adhesives, etc can secure the paper.

FIG. 2 illustrates in somewhat simplified fashion a portion of the path of the paper 32 through the printer. It is noteworthy here that although "paper" will be hereafter referred to as the print medium, any of a number of materials can be used as the medium in inkjet printers.

The paper 32 is picked from an input tray and driven into the paper path in the direction of arrow 40. The leading edge of the paper is fed into the nip between a drive roller 42 and an idler or pinch roller 44. From there the paper 32 is driven in a controlled manner into contact with a curved guide 46 that, in cooperation with guide rods 48, directs the leading edge of the paper 32 into tangential contact with the exterior surface 36 of the drum 20. The guide rods are removed from contact with the paper as soon as the paper is loaded.

As the vacuum ports 34 of the drum rotate into contact with the paper 32 the suction established between the paper and drum secures the paper to the drum as the drum continues to rotate in the direction of arrow 50.

Once the printing operation respecting a particular sheet of paper is complete (as discussed below) the paper is removed from the drum. This can be carried out by the controlled, temporary movement of guide prongs 21 (FIG. 2) that pivot about a post 23 into a circumferential grooves 37 formed in the drum. This redirects the paper from the drum to a conveyor belt 39 that delivers the paper to a collection tray.

As the paper 32 is moved by the drum, it passes very closely to, but does not contact, the undersides of the sets of inkjet pens that are carried near the drum 20. For illustrative purposes, only one set of pens 52, 54 is shown in FIGS. 1 and 2. In the present description, the term "pen" is intended to mean any conventional device for storing and printing droplets of ink therefrom. Sometimes these devices are referred to as cartridges or printheads. In a preferred embodiment, pens such as those available from Hewlett Packard Co. for use with the 2000 Series Color Printer (part numbers: C4800A, C4801A, C4802A, and/or C4803A) are preferred. The pens may be connected to remote sources of ink that supplement the ink supply that is stored in each pen.

As explained more fully below, each pen 52, 54 is supported above the paper 32 by a carriage assembly. A printhead is attached to the underside of each pen. The printhead is a planar member and has an array of nozzles through which the ink droplets are ejected. The pens are supported so that the printheads of the pens are maintained at a desired spacing from the paper (such as, for example, from about 0.5 mm to slightly more than 1.5 mm) and so that the arrays of nozzles on the printheads are maintained in substantially parallel relationship with the paper 32 in the direction of the axis of rotation of the drum.

In FIG. 1 the two pens 52, 54 are shown, for illustrative purposes, without the carriage assembly. That assembly, as described below, secures the pens so that one pen is offset relative to the other pen. Specifically, one pen 52 prints a swath of ink that has a predetermined width shown as S1 in FIG. 1.

The second pen 54 of the set of pens 52, 54 is preferably the same color as its mate 52 and is held in the carriage assembly and arranged so that the swath S2 that this pen 54 prints is adjacent to the swath S1 of the other pen 54 in the direction that is parallel to the rotational axis of the drum 20, which direction is depicted as arrow 60 in FIG. 1. The carriage assembly supports the offset pens so that the centerline of each pen is common with a radial projection from the center of the drum, as explained more fully below.

As used here the term "adjacent," means that the swaths S1 and S2 overlap, but only to a degree necessary to account for carriage and printhead manufacturing tolerances (the former of which is made quite small as described below). It will be appreciated, however, that the printheads are controlled so that the nozzles located along the adjacent edges of the printheads are made active or inactive as necessary to ensure that the printed ink does not overlap between the swaths, unless such printed overlap were desired. Consequently, the combined swath SC printed by this set of pens is essentially equal to sum of the swaths S1, S2 of the two pens.

The swath SC is printed as the paper 32 is advanced by the rotating drum 20, and while the pens 52, 54 are held in the carriage without movement relative to the printer.

Figure 4:
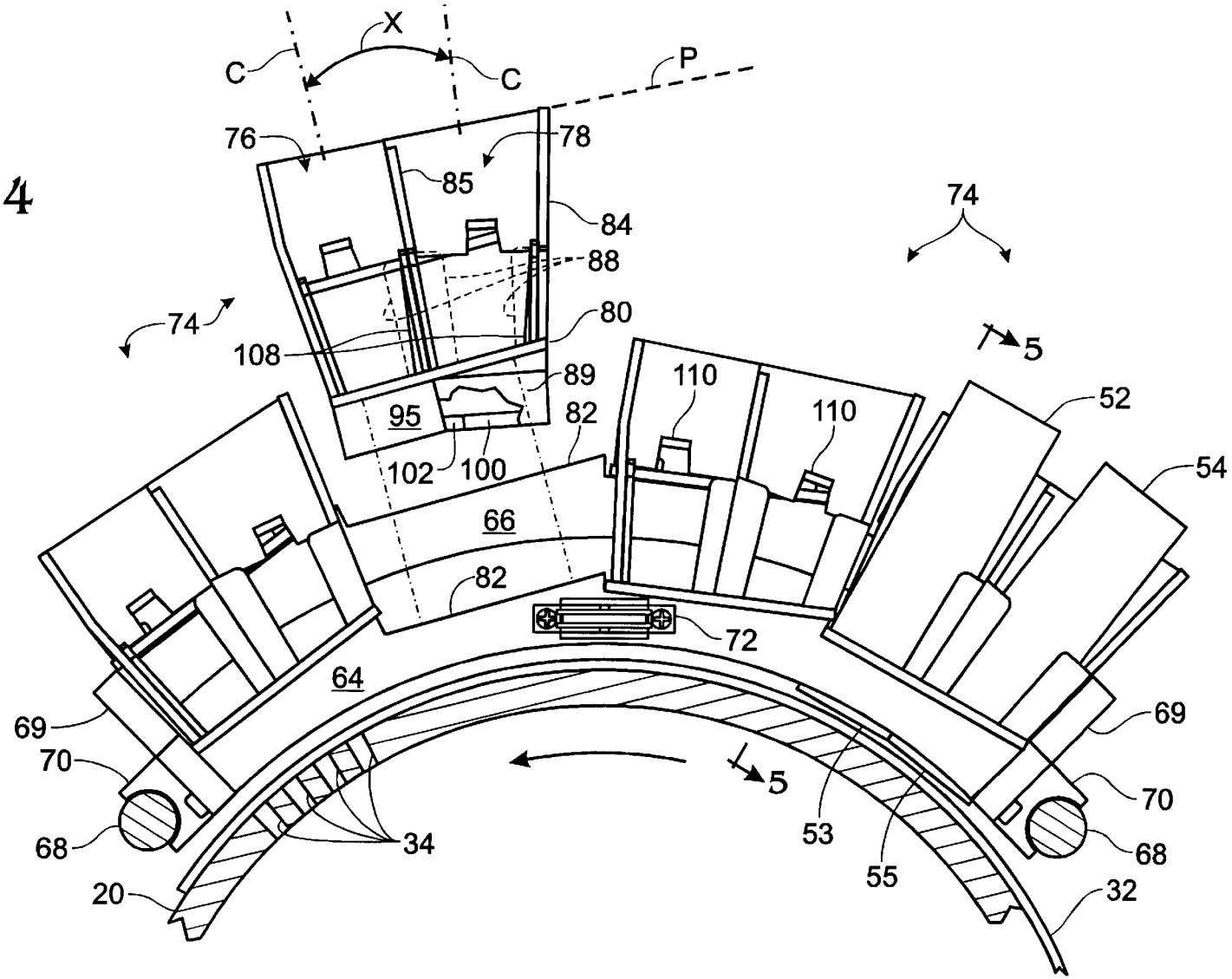
FIG. 4 is an enlarged, partial side view, partly in section, of the carriage assembly as it appears mounted near a drum that advances paper through the printer.

In a preferred embodiment, a group of four sets of two pens each are carried near the drum by four carriage components 74 of a carriage assembly 62 (see FIG. 4). One pen set carries two black ink pens, another carries two magenta ink pens, another carries two cyan ink pens, and the other carries two yellow ink pens. The group of four pen sets are positioned in the carriage assembly so that the centerline "C" (FIG. 2) of each pen is common with a radial projection from the center of the drum. The swaths of each set of two pens align in the direction that the print medium is advanced, thereby to print over the same swath width SC for providing full-color output.

Figure 3:
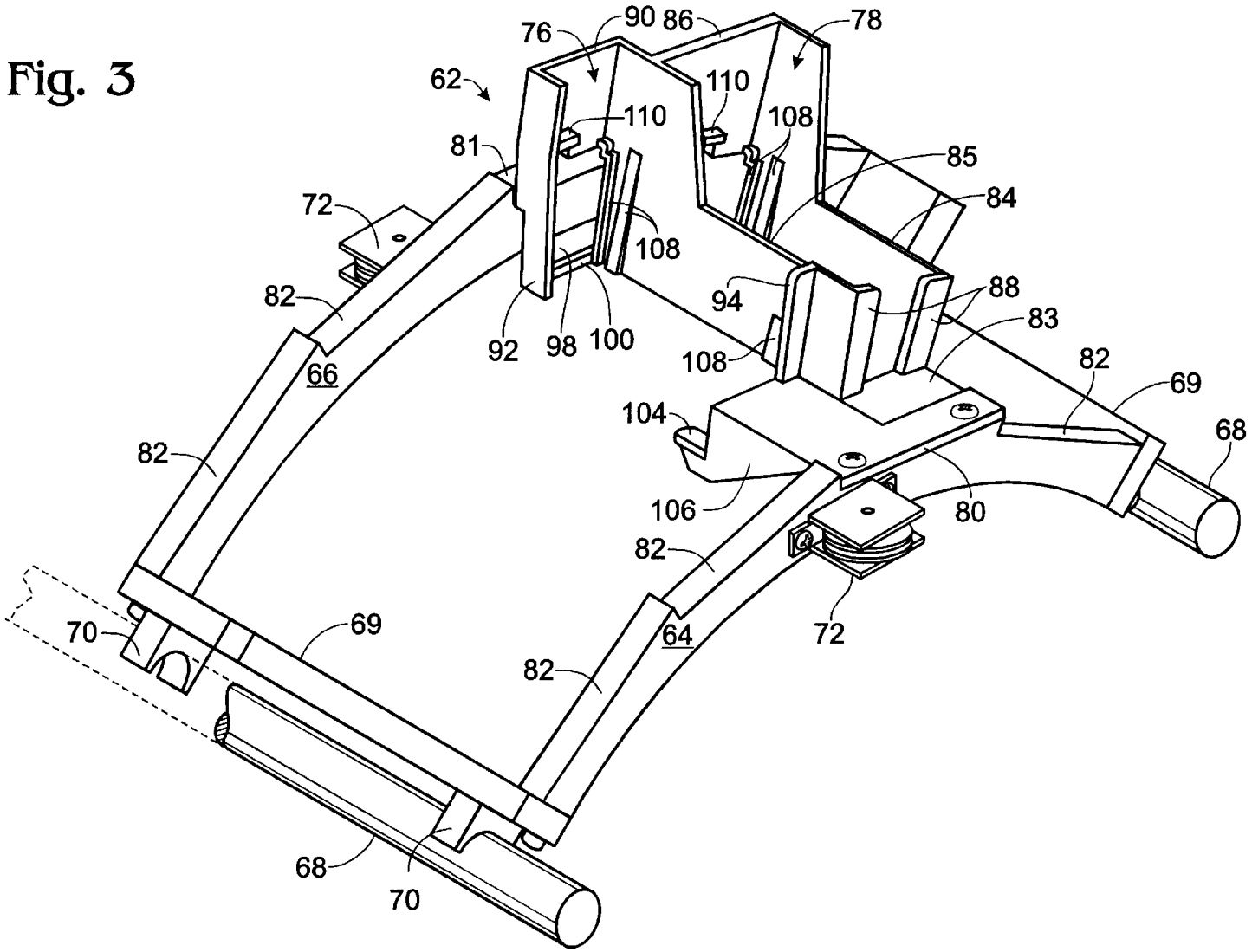
FIG. 3 is a perspective view of a carriage assembly for carrying the pens in accord with the present invention.
Figure 5:
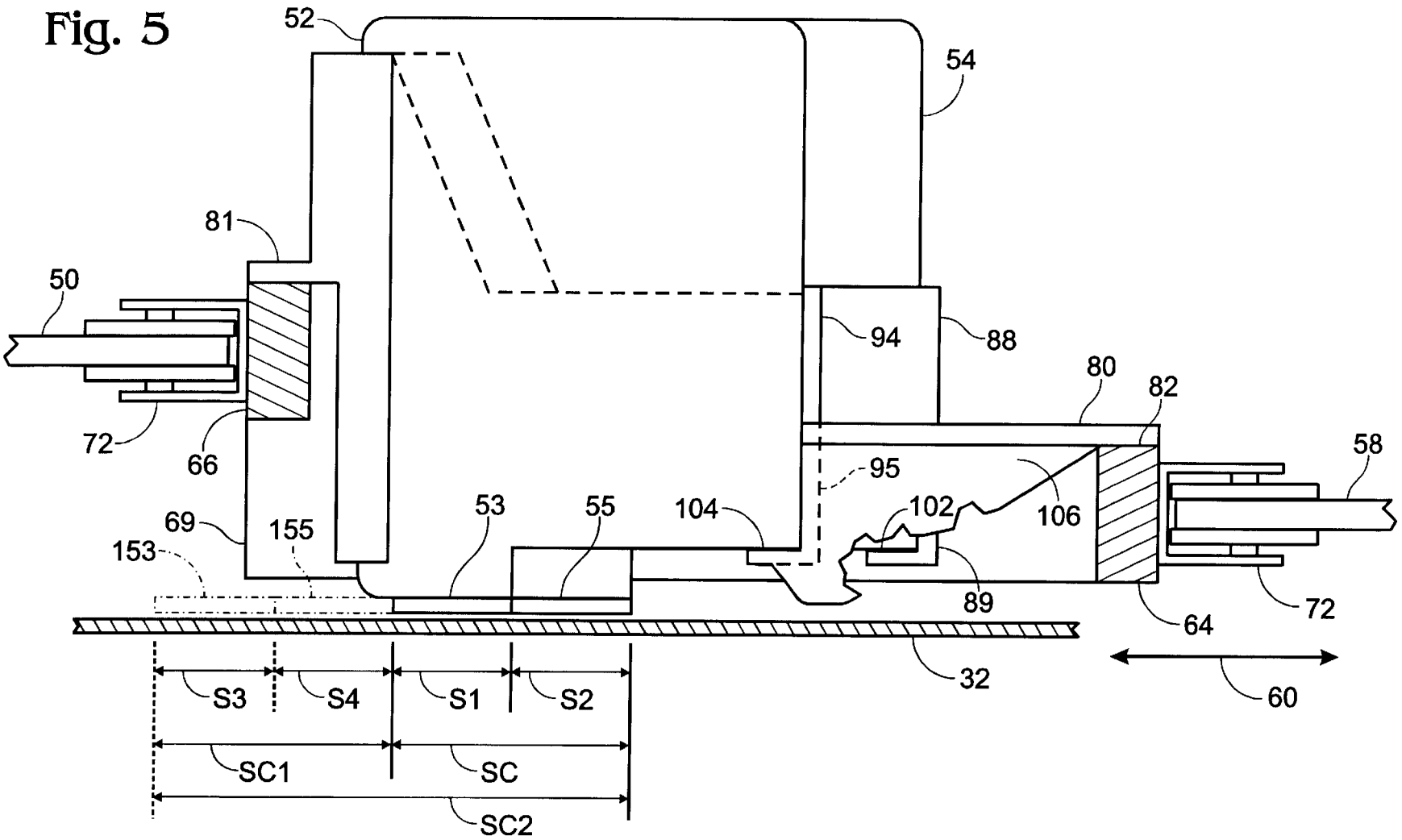
FIG. 5 is an enlarged side view of a component of the carriage assembly for carrying a set of two pens.

Turning now to the particulars of the carriage assembly 62, reference is made to FIGS. 3–5. The carriage assembly 62 includes two, spaced-apart, rigid frame members, which for convenience will be designated as a front frame member 64 and a back frame member 66. The frame members are generally arcuate in shape and span between two guide rods 68 that are fixed to extend across the width of the printer. The opposing ends of each frame member 64, 66 are joined by bridge pieces 69. The bridge pieces have attached thereto generally C-shaped brackets 70 that slidably engage the guide rods 68.

The complete assembly 62 (frame members and carriage components described below) moves as a unit back and forth across the width of the paper. In a preferred embodiment, the carriage movement occurs after one swath SC is printed from the top of the paper to the bottom.

The mechanism for reciprocating the carriage assembly 62 across the paper includes a pair of pulleys 72, one pulley mounted on each frame member 64, 66. The pulleys engage belts 58 that also engage the drive pulleys of motors (not shown) that are responsive to the printer controller for reciprocating the carriage assembly in a conventional manner as needed for a particular printing task.

The present invention permits multiple passes of the paper beneath the pens by merely maintaining carriage position between passes, or by limiting the carriage movement between passes to a distance less than the combined swath width SC. It will be appreciated that although multiple passes are possible with the current invention, the colors associated with the particular pens are printed in the same order, irrespective of what pass is being printed. This has the advantage of eliminating the problem of undesirable banding in the output as discussed above.

If the advances between print passes are made exactly equal to the swath width of a single pen (or an exact integer divisor thereof), then the image data to be printed can be equally divided among the set of contributing pens, leading to a minimization in sensitivity to manufacturing differences between individual printheads.

The frame members 64, 66 support four carriage components 74. For clarity, only a single carriage component 74 is shown in FIG. 3. FIG. 5 shows a carriage component in side view. Preferably, the four carriage components 74 are identical, injection-molded parts, thus the following discussion of one of the carriage components 74 applies to all.

In general, a carriage component 74 includes thin walls that define two adjoining bays 76, 78. The bays are openings into which fit pens such as the above described pens 52, 54. One end of the carriage component 74 includes a flat projecting flange 80 that is fastened to a flat 82 on the front frame member 64. In the preferred embodiment, the upper side of the front and back frame members 64, 66 are each formed with four such flats 82. One flat is angled at about 22.5 degrees relative to the next flat so that the four carriage components 74 mount to those flats in a manner that generally conforms to the curvature of the preferred underlying drum 20.

The flange 80 is integrally formed with and projects from a central wall 85 of the carriage component 74. That wall 85 is roughly perpendicular to the flange and separates the two bays 76, 78. Bay 78 is defined by the central wall 85, an opposing side wall 84, a back wall 86, and a pair of front corner partitions 88 arranged as shown best in FIG. 3. Beneath the flange 80 (FIG. 4) the two partitions 88 are joined into a single front wall 89 of the bay 78.

The other bay 76 is defined by the central wall 85, a back wall 90, a side partition 92, and a front corner partition 94. Beneath the flange 80 (FIG. 4) the front of the bay 76 is defined by a continuous front wall 95.

As respects one bay 78, the side wall 84 converges in the downward direction relative to the central wall so that the size of the bay (measured in a plane perpendicular to FIG. 4) tapers in the downward direction.

As respects the other bay 76, the side partition 92 converges in the downward direction relative to the central wall 85 so that the size of the bay 76 (measured in a plane perpendicular to FIG. 4) also tapers in the downward direction. As will become clear, this taper provides the draft necessary for the simple molding action discussed below.

The part 83 of the flange 80 between the front frame member 64 and the partitions 88 is sloped so that part 83 extends in a plane the is perpendicular to the converging side wall 84 of the bay 78.

As a result of the angular relationships between the central wall 85 and the respective side wall 84 and side partition 92, pens inserted into the bays will have centerlines (FIG. 4) that are angled relative to one another. As will become clear, this angle "X" allows each pen that is inserted into the bay to be oriented such that its center line is common with a radial projection from the center of the drum. As a result, the nozzle array in the planar printhead 53 (which printhead is mounted to the underside of the pen) is substantially parallel to the portion of the paper to which the printhead is closest.

In the preferred embodiment, the angle "X" between the pens is 10.75 degrees. This angle is a function of the drum circumference and the printhead size; wherein the printheads of two offset pens are secured as close as possible at the same radial distance from the center of the drum.

In this embodiment, the back walls 86, 90 of the bays include clearance openings 98 through which are exposed parts of the inserted pens that carry conductive contacts. These contacts are the exposed termini of circuitry internal to the pen for driving the printheads to print ink. These pen contacts are thus accessible in the bay for contact with mating contacts carried on the back frame member 66, which communicate, as by a ribbon-type multi-conductor, with the printer controller. The electrical connection of the pens in the carriage components forms no part of the present invention.

As shown in FIG. 5, a tab 81 projects from the back walls 90, 86 of each bay to be secured to the flat 82 on the back frame member 66 in a manner similar to how flange 80 is secured to the front frame member 64.

The precise, repeatable positioning of a pen within a bay is accomplished with the use of features that are integrally formed with the carriage component 74 and mate with or otherwise engage corresponding parts on the pen body. For example, a beam feature 100 spanning the lower end of each back wall 90, 86 limits the downward movement of the back end of a pen into a bay.

Above the beam 100 in each bay is an inwardly projecting lip 110 that engages a part of the pen to permit the fully inserted pen to be snap-fit into the bay of the carriage component.

Inside one bay 78, the downward limit or support for the front end of an inserted pen is made by a horizontally projecting feature 102 formed in the corner of the front wall 89 and the central wall 85 surface that faces the bay 78.

A horizontally projecting feature 104 is provided in the other bay 76 and corresponds in function to the feature 102 in bay 78, as just described. This feature 104 (see FIG. 5) is supported in space by a gusset 106 that depends from the underside of the flange 80 and joins the edge of the front wall 95 of this bay.

The precise positioning of the pens in the bays is also facilitated by projecting guide features, such as shown at 108 in each bay. These guides 108 are gradually thickened (that is, they project further from the walls with which they are integrally formed) in the downward direction to facilitate guiding of the pen into snug fit against the lower limit features 100,102,104 described above.

With particular reference to FIGS. 1 and 5, it will be clear that the carriage components 74 are formed so that the set of pens they carry are arranged to be offset in a direction that is parallel to the rotational axis of the drum 20. Thus, as described above, the swath S1 of one pen 52 and the swath S2 of its same-color mate 54 in that set are adjacent one another in the direction, shown as arrow 60, that is parallel to the rotational axis of the drum 20. As noted, the swaths S1 and S2 are adjacent but overlap to a degree necessary to account for carriage and printhead manufacturing tolerances so that the combined swath SC printed by this set of pens is essentially the sum of the swaths S1, S2 of the two pens.

In a preferred embodiment, the carriage components align the other three sets of pens so that three other colors (in addition to, say, the black ink printed by pens 52 and 54)

may be printed in the same swath SC for a given pass of the paper length relative to the carriage assembly 62. Full-color output is thus available.

It will be appreciated that fewer or more sets of pens may be mounted to a carriage assembly in a way to carry out the swath-increasing aspect of the present invention. For example, the carriage assembly could be configured to carry a second group of four sets of two same-color pens. This second group is arranged so that aligned printheads (two of which are shown in dashed lines 153,155 of FIG. 5) combine their adjacent swaths S3, S4 into a resultant swath SC1 that is shifted in the direction 60 parallel to the drum axis, but adjacent to the first group swath SC. Thus, this second group would combine with the first group to provide an overall swath width SC2 reflecting the combination of four adjacent print heads.

Sets of pens need not be limited to pairs of same-color pens. Sets employing three or more same-color pens, or employing more than four differing ink colors are also contemplated.

It is also contemplated that a sufficient number of groups of pen sets may be assembled on a carriage assembly (an assembly, for example that surrounds nearly all of the drum) so that the resulting combined swath would extend across the entire width of paper, thereby eliminating the need for mechanisms to move the carriage relative to the printer body.

In the preferred embodiment, the sets of same-color pens are secured in the carriage component 74 so that the associated same-color swaths are precisely aligned with no gap or overlap, which would result in noticeable degradation of print quality. This precise relative positioning is dependent upon the precise relative positioning of the molded features (100, 102, 104, 108 etc) in the adjoining bays 76, 78.

Considering the above described individual carriage components 74, one of ordinary skill will readily note that the portion of the component that includes these features can be injection molded inside of a single mold part, requiring only open and shut mold action (hence, without the use of a slide). Thus, since the features are not shaped as a result of moving mold parts, and since those features do not extend across a parting line (such as illustrated in the dashed line "P" of FIG. 4) of the molds, very low tolerances may be specified for the dimensional relationships of features in adjoining bays. This translates into very close pen-to-pen tolerances for precisely adjacent swaths. In a preferred embodiment, the resultant pen-to-pen tolerance was established between 10 $\mu$m and 15 $\mu$m.

It will be appreciated that although a preferred embodiment of a carriage assembly has been described, a number of carriage configurations would suffice for carrying out the swath-increasing aspects of the present invention. Thus, while the present invention has been described in terms of preferred and alternative embodiments, it will be appreciated by one of ordinary skill that the spirit and scope of the invention is not limited to those embodiments, but extend to the various modifications and equivalents as defined in the appended claims.

What is claimed is:

1. A method of combining in a printer the swaths of two sets of two pens, wherein each pen has an associated swath of a predetermined width and across which swath ink is printed onto a print medium, the method comprising the steps of:

advancing the medium over a drum that rotates about an axis; and carrying a first set of two pens near the drum;

carrying a second set of two pens near the drum; and printing the ink from both sets of pens while the drum is rotating so that the width of a swath of the printed ink is substantially the sum of the swath widths of the two pens of the first set.

2. The method of claim 1, including the steps of:

moving the first and second sets of pens in a direction parallel to the axis of the drum by an amount less than or equal to the width of an individual printhead; and printing an image by expelling ink from the first and second sets of pens while the drum is rotating so that the swath printed after moving the pens overlaps the swath printed before moving the pens and so that the pens used for printing the image contribute substantially equally to the image.

3. The method of claim 1 including the steps of:

moving the sets of pens in a direction parallel to the axis of the drum and by an amount less that the sum of the swath widths of the two first-sat pens; and printing ink from the pens while the drum is rotating so that the swath printed after moving the sets of pens overlaps the swath printed before moving the pens.

4. The method of claim 1 wherein the ink color of the second set of pens is different from the ink color of the first set of pens.

5. The method of claim 1 wherein the ink color of both pens of the second set of pens is the same.

6. The method of claim 5 wherein the swaths of the second set of pens are adjacent to the swaths of the first set of pens in a direction that is parallel to the drum axis.

7. The method of claim 1 including the steps of:

carrying a third set of two pens;

carrying a fourth set of two pens; and locating the sets of pens near the drum with the two pens of each set being arranged such that the swaths of the pens of each set are adjacent to one another in a direction that is parallel to the drum axis.

8. A method of combining in a printer the swaths of two pens having the same color ink, the method comprising the steps of:

advancing the medium through the printer over a drum that rotates about an axis;

carrying in a carriage component a set of two pens near the drum so that one pen is carried at an angle relative to the other pen;

wherein the carriage component includes features for positioning the pens in the carriage component, the method including the step of molding the features of the carriage component in a mold while using no mold motion other than the opening and closing the mold.

9. The method of claim 8 including the step of molding the features of the carriage component on a common side of a parting line of a mold.

10. A printer system comprising:

a drum for carrying print medium, the drum being rotatable about an axis to advance the medium in a first direction;

a first and second carriage component mounted near the drum, each carriage component and including two bays, each bay for receiving an ink pen that has an associated print swath, wherein the bays are arranged so that when pens are received therein the printed swaths of the two pens of one carriage component are adjacent one another in a direction parallel to the axis of the drum; and wherein the bays are arranged so that the two pens of the first carriage component are aligned in the first direction with the two pens of the second carriage component, so that the two pens of the second carriage component print over the swath printed by the two pens of the first carriage component.

11. The system of claim 10 wherein the pens have centerlines and printheads from which ink is expelled and wherein the bays are arranged so that the centerlines of the pens are held common with respective radial lines relative to the drum, thereby to place at least part of the printheads in substantially parallel relationship with the print medium.

12. The system of claim 10 further comprising a carriage frame for supporting the carriage components for reciprocating movement in a direction substantially parallel to the drum axis.

13. The system of claim 12 wherein the carriage frame is configured to support the carriage components in an orientation that conforms to the shape the drum.

14. A carriage for an inkjet printer, comprising a frame mounted in the printer;

a first carriage component mounted to the frame and having walls that define two bays into each of which is inserted an inkjet pen, wherein the first carriage component is molded, and wherein an inkjet pen that is inserted into one bay is carried at an angle relative to another pen that is inserted into the other bay; and wherein the bays of the first carriage component include features thereon for controlling the location of the inkjet pens that are inserted into the bays, the features being molded without mold motion other than opening and shutting of the mold.

15. The carriage of claim 14 including a second carriage component mounted to the frame and matching the first carriage component.

16. The carriage of claim 14 wherein the bays are arranged so that one bay is offset relative to the other bay.

* * * * *